US006109936A

United States Patent [19]

Tan et al.

[11] Patent Number: 6,109,936

[45] Date of Patent: Aug. 29, 2000

[54] GROUNDING CLIP FOR USE WITH AN ASSOCIATED AUDIO JACK

[75] Inventors: Haw-Chan Tan, Diamond Bar; Joel Jyh-Haur Yeh, San Gabrie, both of Calif.; Yao-Hao Chang, Chung-Ho, Taiwan

[73] Assignee: Hon Hai Precision Ind. Co., Ltd., Taipei Hsien, Taiwan

[21] Appl. No.: 09/461,681

[22] Filed: Dec. 14, 1999

Related U.S. Application Data

[63] Continuation of application No. 09/056,058, Apr. 6, 1998, Pat. No. 6,004,146, which is a continuation of application No. 08/655,956, May 31, 1996, Pat. No. 5,735,699.

[51] Int. Cl.[7] ..... H01R 4/66

[52] U.S. Cl. ..... 439/92

[58] Field of Search ..... 439/581, 578, 439/585, 620, 541.5, 540.5, 638, 701, 79, 80, 63, 92, 939, 947; 174/51; 361/753, 799

[56] References Cited

U.S. PATENT DOCUMENTS 5,326,280 7/1994 Briones et al. ..... 439/581
5,643,008 7/1997 Tan et al. ..... 439/541.5

*Primary Examiner*—Brian Sircus
*Assistant Examiner*—J. F. Duverne
*Attorney, Agent, or Firm*—Wei Te Chung

[57] ABSTRACT

An electrical connector assembly (10) includes a universal bracket (12) for retaining at least a group of audio jack units (17) therein. Each audio jack unit (17) includes a plurality of signal contacts (22) and at least a grounding contact (24) thereof for mounting to a mother board (100) on which the assembly (10) is seated. A grounding clip (26) is retainably attached to the corresponding audio jack unit (17) under the condition that one spring finger (38) thereof contacts the grounding contact (24) and an engagement tang (46) thereof projects out of the front surface (49) of the universal bracket (12) for efficient engagement with the front panel of the computer case which the bracket (12) confronts.

3 Claims, 6 Drawing Sheets

GROUNDING CLIP FOR USE WITH AN ASSOCIATED AUDIO JACK (This application is a continuation of application Ser. No. 09/056,058 filed on Apr. 06, 1998 now U.S. Pat. No. 6,004,145 which is a continuation of application Ser. No. 08/655,956 filed on May 31, 1996, now U.S. Pat. No. 5,735,699 issued on Apr. 07, 1998)

BACKGROUND OF THE INVENTION

1. Field of The Invention

The invention relates to a grounding clip for use with an associated audio jack which is embedded within a universal frame with other juxtaposed similar audio jacks wherein such grounding clip substantially projects out of the vertical surface of the frame for engagement with the front panel of the computer case.

2. The Prior Art

The copending U.S. patent application Ser. No. 08/524,333 filed on Sept. 6, 1995, now U.S. Pat. No. 5,643,008, discloses a universal frame simultaneously supportable retains a D-Subminiature type Input/Output connector at a higher lever and a three-in-one integral audio jack assembly at a lower lever for respectively connecting to the corresponding peripheries. In such design, each audio jack unit has a grounding contact extending downward out of the bottom surface to solderably mount to the grounding circuits on the mother board, on which the universal frame including the D-Sub and the audio jack assembly is seated, and then such grounding circuits are electrically engaged with the grounding basis, i.e., the metal case of the computer. It is experienced that the grounding path should be as short as or as close to the grounding basis as possible for not interference with the active signal transmission in signal circuits. Thus, it is desired that an additional grounding clip is required to be used with the corresponding associated audio jack unit for directly grounding the audio jack unit to the front panel against which the audio jack abuts, and most of the grounding path is no longer through the grounding circuits on the mother board.

An object of the invention is to provide the grounding clip in conformance with the configurations of the aforementioned existing universal frame and its associated audio jack assembly such that is easy to attach the additional grounding clip to the whole assembly without redesigning the existing basic structure of the original assemble.

According to an aspect of the invention, an electrical connector assembly includes a universal bracket for retaining at least a group of audio jack units therein. Each audio jack unit includes a plurality of signal contacts and at least a grounding contact thereof for mounting to a mother board on which the assembly is seated. A grounding clip is retainably attached to the corresponding audio jack unit under the condition that one spring finger thereof contacts the grounding contact and an engagement tang thereof projects out of the front surface of the universal bracket for efficient engagement with the front panel of the computer case which the bracket confronts.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
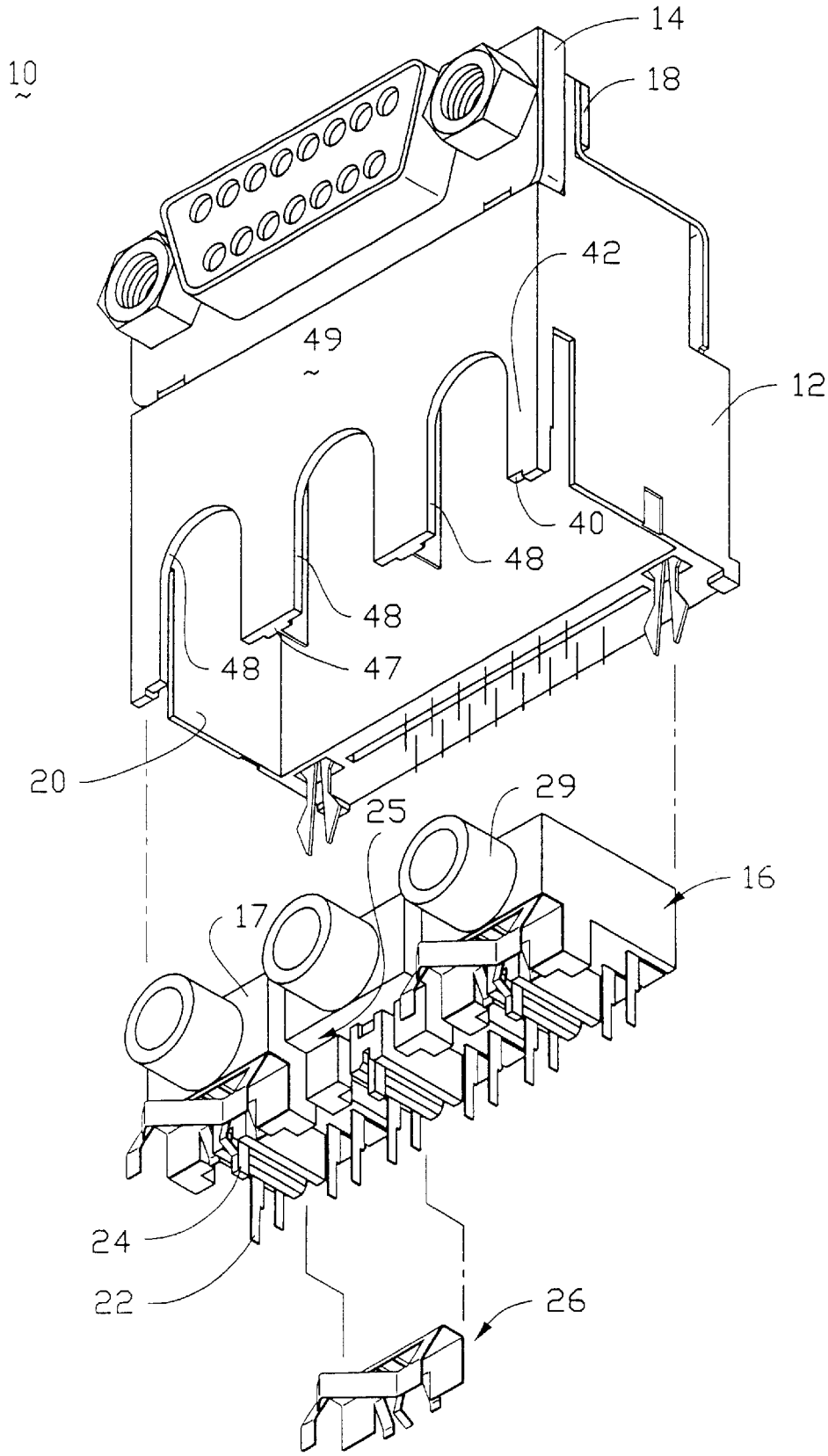
FIG. 1 is an exploded perspective view of a presently preferred embodiment of an electrical connector assembly according to the present invention.
Figure 2:
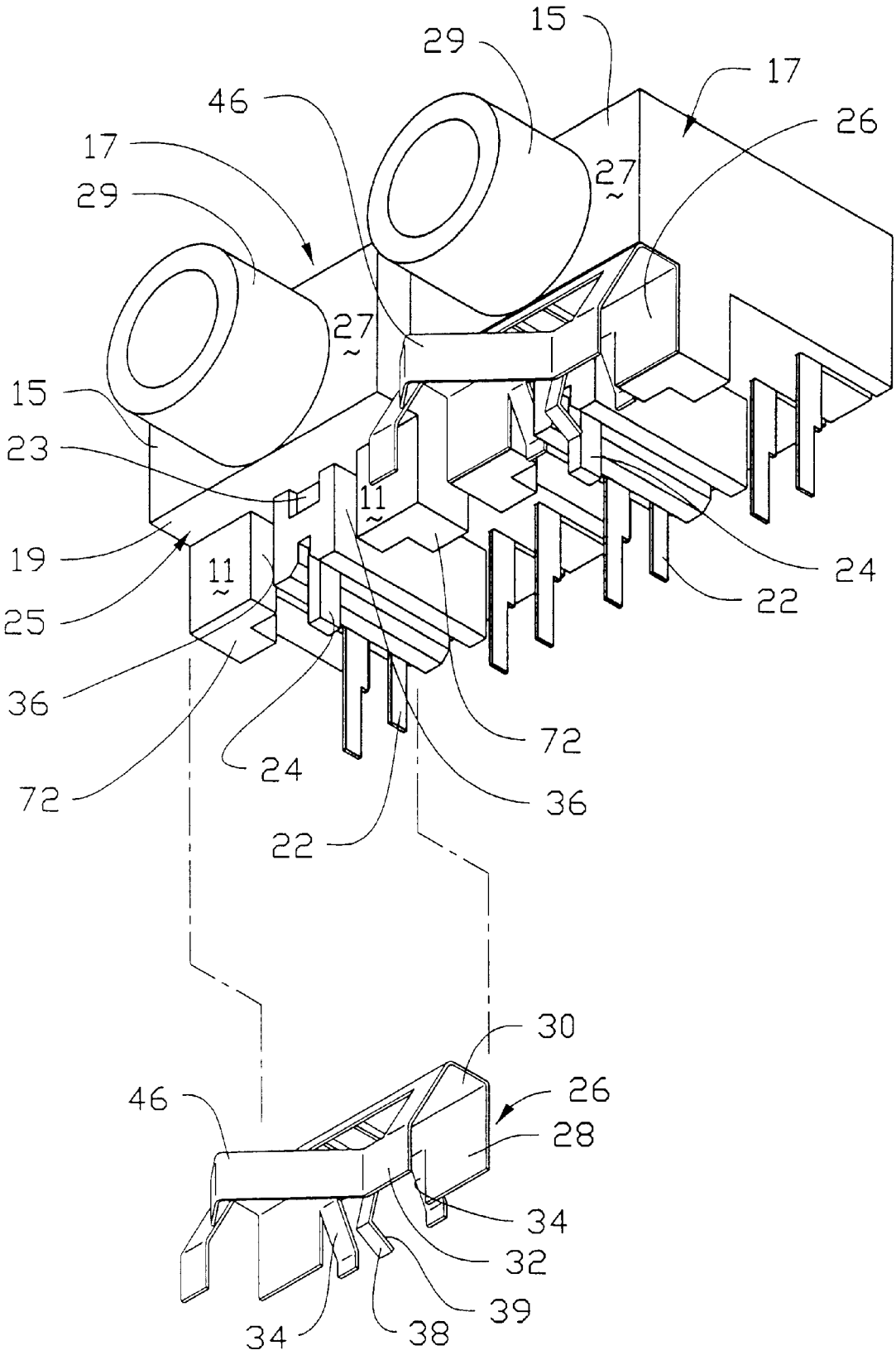
FIG. 2 is an enlarged partially perspective view of the electrical connector assembly of FIG. 1 to show respectively the audio jack unit and the corresponding grounding clip and assembling thereof.
Figure 3:
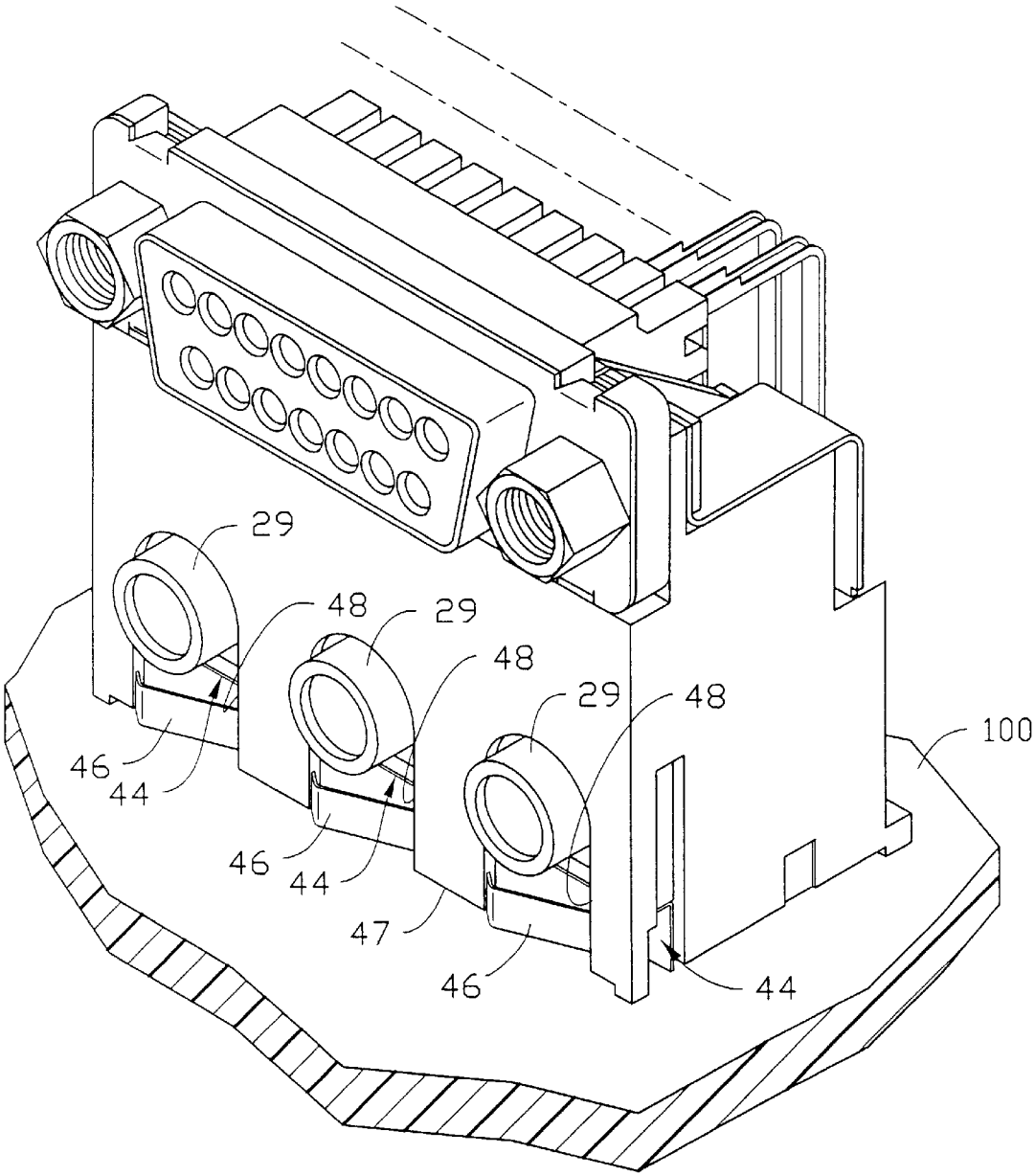
FIG. 3 is a perspective view of the assembled electrical connector assembly of FIG. 1 on a mother board to show the tang of the grounding clip projects out of the opening of the bracket and beyond the front surface of the bracket for being ready to be engaged with the front panel of the computer case.

It will be noted here that for a better understanding, most of like components are designated by like reference numerals throughout the various figures in the embodiments. Attention is directed to FIGS. 1–3 wherein an electrical connector 10 includes a universal frame or bracket 12 made of plastics for retaining a D-Subminiature (hereinafter D-Sub) connector 14, which has been fastened to the bracket 12 in FIG. 1, and a three-in-one integral audio jack assembly 16 thereto, wherein the D-Sub connector 14 is attached to the bracket 12 from an exterior and fastened thereto by a pair of rivets 18 (only one shown) on two opposite ends, and the audio jack assembly 16 is retainably, in an interference fit, received within and upwardly installed into a downward huge cavity 20 defined in the lower portion of the bracket 12. The structures of bracket 12, the D-Sub connector 14 and the audio jack assembly 16 can be referred to the aforementioned copending application 08/524,333.

The audio jack assembly 16 is composed of three audio jack units 17 integrally side by side formed with each other while each unit 17 has its own signal contacts 22 and a grounding contact 24, referring to FIG. 2. As mentioned before, to enhance the grounding effects and to avoid excessively interfere with the signal circuits on the mother board 100 (FIG. 3), on which the electrical connector assembly 10 is seated, by such grounding contact 24 through the corresponding grounded circuits on the mother board, an additional grounding clip 26 is designedly arranged to be attached to each audio jack unit 17 and generally occupies an indent 25 adjacent the front portion of the audio jack unit 17 under the condition of conductive connection with the corresponding grounding contact 24.

Referring to FIG. 2, the subject conductive grounding clip 26 is of a generally U-shaped cross-sectional configuration, including a rear wall 28, a top wall 30 and a front wall 32 wherein a pair of retention legs 34 extend rearwardly and angularly of the rear wall 28 for retainably respectively received within the corresponding slots 36 in the body 15 of the audio jack unit 17 so as to retain the grounding clip 26 to the audio jack unit 17, and wherein the rear wall 28 substantially abuts against the offset vertical plane 11 of the body 15 of the audio jack 17. A spring finger 38 forwardly and angularly extends of the rear wall 28 and between such pair of retention legs 34, whereby when the grounding clip 26 is fastened to the body 15 of the audio jack unit 17 by means of the retention legs 34 retained within the slots 36 of the body 15, the distal end 39 of spring finger 38 abuts against the grounding contact 24 for efficient conductivity.

Also referring back to FIGS. 1 and 3, the top wall 30 butts against the undersurface 19 of the body 15 of the audio jack unit 17, and the front wall 32 generally confronts the inner surface 40 of the front vertical plate 42 of the bracket 12. In other words, the grounding clip 26 can be snugly embedded within a space 44 defined between the inner surface 40 of the front vertical plate 42 of the bracket 12 and the offset vertical plane 11 of the body 15 of the audio jack unit 17, and under the undersurface 19 of the body 15 of the audio jack unit 17. A engagement tang 46 forward projects out of the opening 48 in the front vertical plate 42 and substantially also out of the front surface 49 of the vertical plate 42 for engagement with a front panel (not shown) for quick and efficient grounding effect. Therefore, any undesired signals captured by the grounding contact 24 may tend to be transferred therefrom to the grounding clip 26, instead of to the grounded circuits on the mother board 100, via the shorter grounding path (i.e., the grounding clip 26) to the grounding basis (i.e., the aforementioned front panel (not shown) of the computer case) wherein as mentioned before, the engagement tang 46 substantially engages such front panel for grounding effect.

It is appreciated that even though the bodies 15 of the audio jack units 17 are integrally formed as one piece, the grounding clips 26 are respectively attachably assembled to each corresponding audio jack unit 17. The grounding clip 26 in this embodiment, not only is adapted to be easily reliably fixed to the audio jack assembly 16, but also can fully comply with the previous existing structures of the audio jack assembly 16 without further changing the original design thereof. In other words, the grounding clip 26 utilizes the unused space and/or structures of the original electrical connector assembly 10 to implement the additional specific function, i.e., grounding effect, without varying the original required configuration, thus providing a better performance thereof. For example, the grounding clip 26 can be received within the indent 25 originally arranged in the audio jack unit 17 and its engagement tang 46 projects out of the originally existing opening 48 in the vertical plate 42, and therefore, no additional structure change is required to comply with the additive grounding clip 26. It can be seen that the opening 48 extends downward to the bottom edge 47 of the bracket 12 for allowing upward loading (of the mating port 29) of the audio jack unit 17, and then after assembled, the engagement tang 46 of the grounding clip 26 and the mating port 29 of the audio jack unit 17 commonly project out of the opening 48 of the bracket 12 wherein the mating portion 29 of the audio jack unit 17 is positioned on the upper portion thereof and the engagement tang 46 is positioned on the lower portion thereof.

Figure 4:
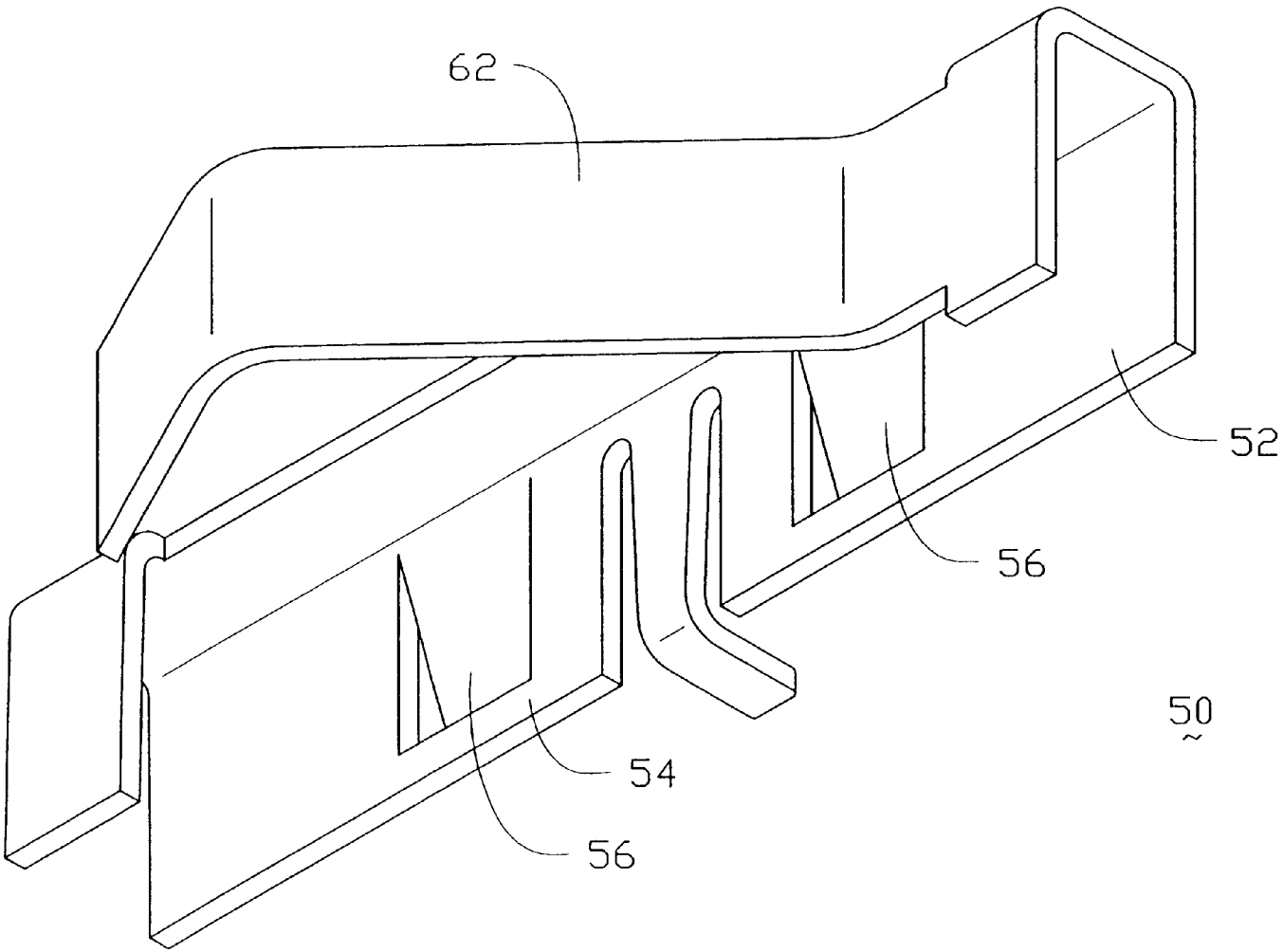
FIG. 4 is a perspective view of another embodiment of the grounding clip for use with the electrical connector assembly of FIG. 1.

FIG. 4 shows another embodiment of the grounding clip 50 wherein the rear wall 52 has larger integral portions 54 which surrounds tie retention legs 56. Similar to the first embodiment, the whole height of the rear wall 52 should be not more than the depth of the indent 25 of the audio jack unit 17 so that such grounding clip 50 may be snugly embedded within such indent 25 with its engagement tang 62 projecting out of the opening 48.

Figure 5:
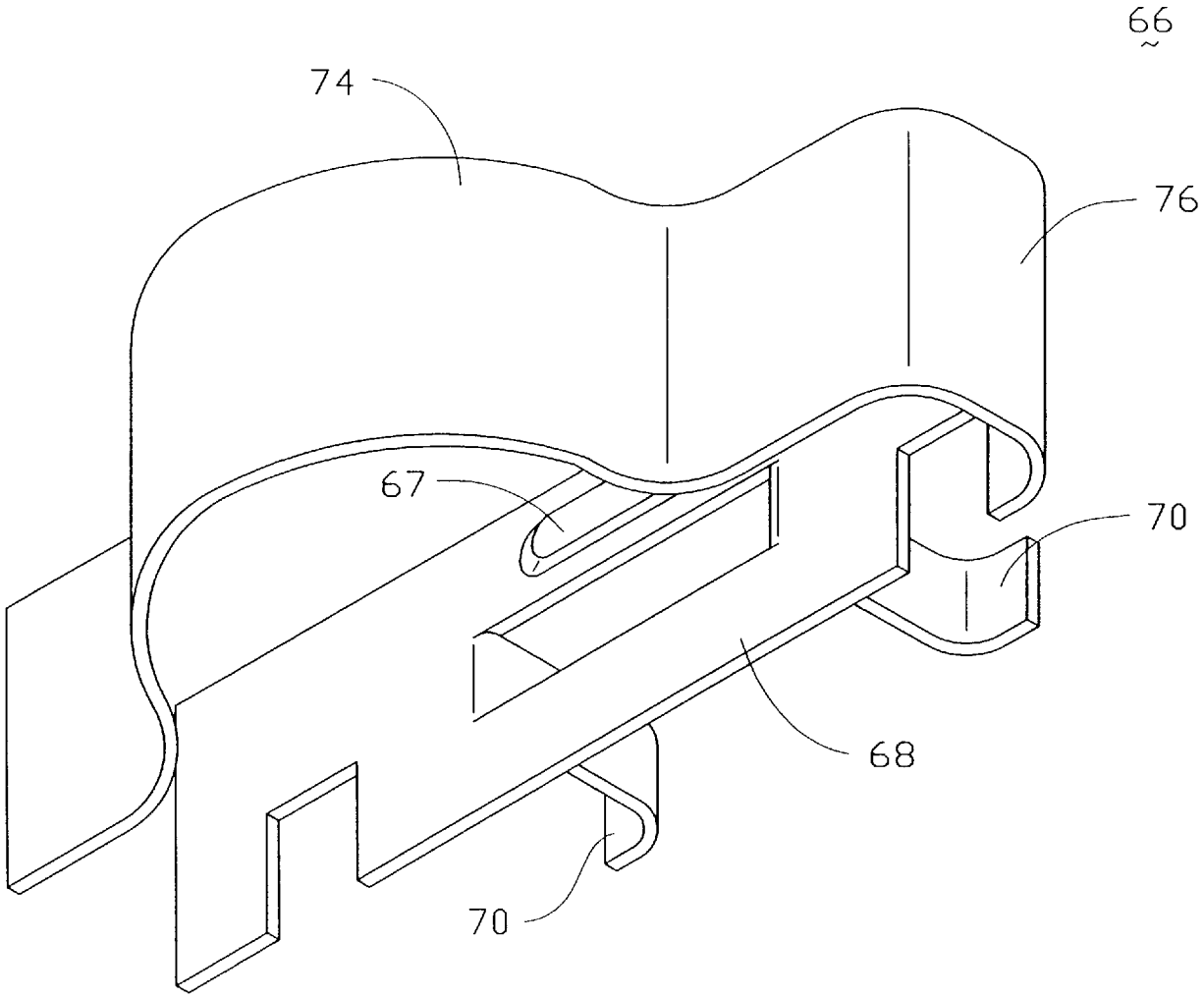
FIG. 5 is a third embodiment of the grounding clip for use with the electrical connector assembly of FIG. 1.

FIG. 5 discloses a third embodiment of the grounding clip 66 wherein the rear wall 68 thereof includes a pair of L-shaped retention legs 70 adapted to grasp at the shoulders 72 (FIG. 2) of the audio jack unit 17 for fastening the grounding clip 66 to the body 15 of the audio jack unit 17. The engagement tang 74 extending from the front wall 76 also projects out of the opening 48 of the audio jack unit 17. One difference between this third embodiment and the previous two embodiments, is that in this embodiment the grounding clip 66 contacts the grounding contact 24 at a tip 23 of the grounding contact 24 via an embossment 67 of the grounding clip 66, instead of using a spring finger 38 to contact the tail of the grounding contact 24 as shown in FIG. 1.

Figure 6:
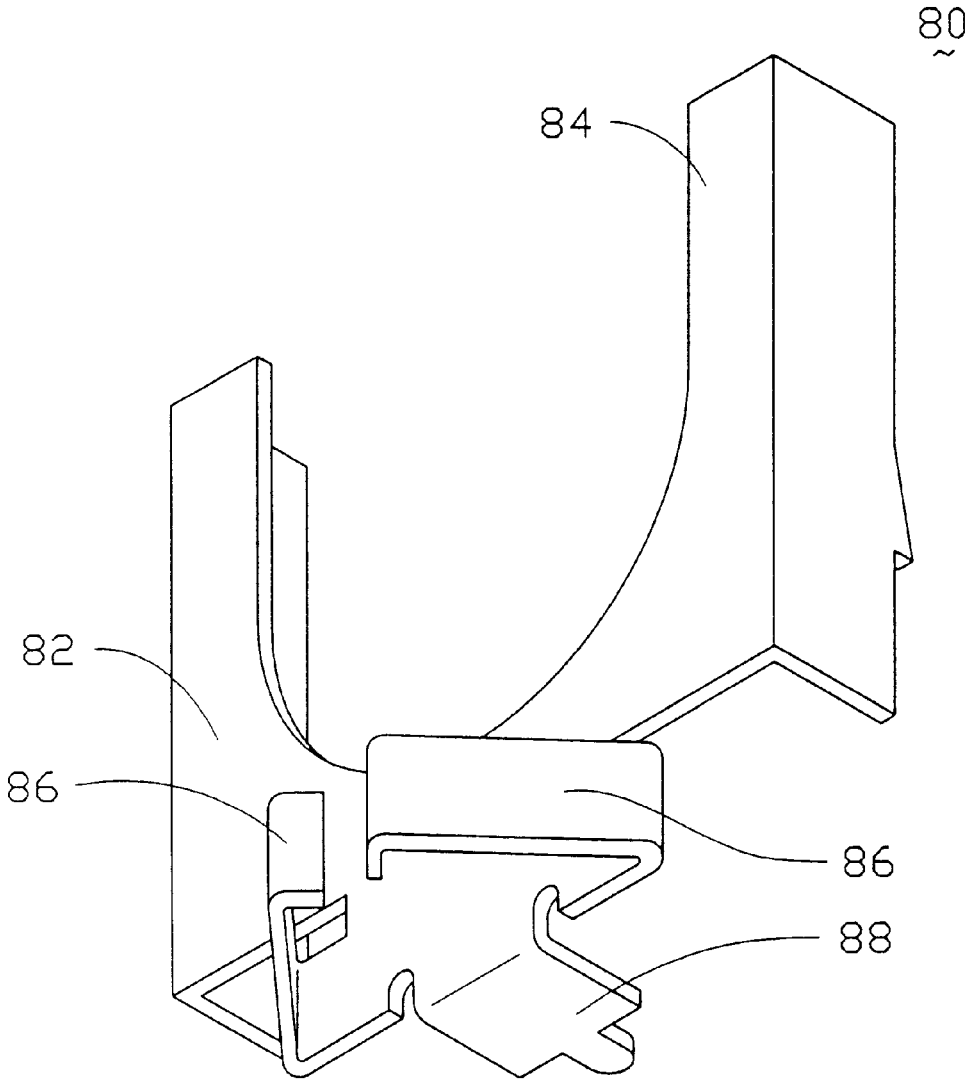
FIG. 6 is a fourth embodiment of the grounding clip for use with the electrical connector assembly of FIG. 1.

FIG. 6 discloses a fourth embodiment of the grounding clip 80 wherein an main base 82 with a U-shaped cut 84 generally retainably covers the front vertical plane 27 (FIG. 2) of the audio jack unit body 15. A pair of engagement tangs 86 project out of the opening 48 of the bracket 12. A spring finger 88 rearward extends from the edge of the engagement tangs 86 to a position adjacent the grounding contact 24 whereby when the tangs 86 is pressed by the panel (not shown) of the computer case, the spring finger 88 can contact the grounding contact 24 for grounding function.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included within the scope of the following claims.

We claim:

1. An electrical connector assembly comprising:

a bracket having a vertical front plate on an outermost surface thereof, a cavity defined under the bracket, and at least an opening defined on the front plate to communicate with said cavity along a front-to-back direction;

a first connector unit positioned above the bracket;

a second connector unit consisting of a body enclosed within the cavity of the bracket, and a mating port forwardly projecting through and out of the opening of the bracket from the body; and a grounding member having a wall portion located within the cavity to abut against the second connector unit therein, and an engagement portion electrically connected with the wall portion and forwardly extending through and out of the vertical front plate of the bracket for electrical engagement with a panel of a computer case wherein the grounding member is directly electrically connected with a grounding contact extending downwardly of the body of the second connector unit to a circuit board on which said electrical connector assembly mounted for shorting a grounding path of the second connector unit.

2. The electrical connector assembly as described in claim 1, wherein the engagement portion of the grounding member extend through the vertical front plate of the bracket via a position adjacent to the opening.

3. An electrical connector assembly comprising:

a bracket defining an upper portion and lower portion;

a first connector positioned around the upper portion; and a second connector positioned around the lower portion wherein said bracket further defines a front vertical plate around the lower portion with therein an opening through which a mating portion of the second connector protrudes out of the front vertical plate; and a grounding member having a portion positioned around the lower portion of the bracket to electrically connected with a grounding contact located under the second connector, and another portion protruding out of the front vertical plate for contacting a panel of the computer case.

* * * * *